US009279238B2

(12) United States Patent
Flessa et al.

(10) Patent No.: US 9,279,238 B2
(45) Date of Patent: Mar. 8, 2016

(54) PLUMBING FIXTURE HAVING A TENSIONING MEMBER

(71) Applicant: Grohe AG, Hemer (DE)

(72) Inventors: Thomas Flessa, Schwarzenbach a. Wald (DE); Thomas Loi, Luedenscheid (DE)

(73) Assignee: Grohe AG, Hemer (DE)

( * ) Notice: Subject to any disclaimer, the term of this patent is extended or adjusted under 35 U.S.C. 154(b) by 69 days.

(21) Appl. No.: 14/201,042

(22) Filed: Mar. 7, 2014

(65) Prior Publication Data

US 2014/0251453 A1 Sep. 11, 2014

(30) Foreign Application Priority Data

Mar. 7, 2013 (DE) ..... 10 2013 003 827

(51) Int. Cl.
*E03C 1/04* (2006.01)

(52) U.S. Cl.
CPC ..... *E03C 1/04* (2013.01); *E03C 1/0403* (2013.01); *E03C 1/0404* (2013.01); *E03C 2001/0416* (2013.01); *Y10T 137/6014* (2015.04)

(58) Field of Classification Search
CPC ..... E03C 1/04; E03C 1/0403; E03C 1/0404
USPC ..... 137/315.12, 454.5, 454.6
See application file for complete search history.

(56) References Cited

U.S. PATENT DOCUMENTS

| | | | | |
|---|---|---|---|---|
| 5,063,961 | A * | 11/1991 | Brunner | 137/454.5 |
| 5,368,071 | A | 11/1994 | Hsieh | |
| 6,179,130 | B1 | 1/2001 | Nguyen et al. | |
| 2013/0133753 | A1 | 5/2013 | Thomas | |

FOREIGN PATENT DOCUMENTS

| | | | |
|---|---|---|---|
| DE | 199 11 066 | A1 | 9/2000 |
| EP | 1479834 | A2 * | 11/2004 |
| WO | WO 2012/013318 | A1 | 2/2012 |

* cited by examiner

*Primary Examiner* — Kevin Lee
(74) *Attorney, Agent, or Firm* — Muncy, Geissler, Olds & Lowe, P.C.

(57) ABSTRACT

A plumbing fixture having at least a housing, which forms an opening surrounded by a collar and an interior space, a fastening member, which can be disposed adjacent to the collar in the housing, a cartridge holder, which can be positioned in the interior space, a cartridge, which can be positioned at least partially in the interior space, and a tensioning member, which by direct contact can tension at least the cartridge or the cartridge holder against the fastening member.

10 Claims, 3 Drawing Sheets

PLUMBING FIXTURE HAVING A TENSIONING MEMBER

This nonprovisional application claims priority under 35 U.S.C. §119(a) to German Patent Application No. 10 2013 003 827.8, which was filed in Germany on Mar. 7, 2013, and which is herein incorporated by reference.

BACKGROUND OF THE INVENTION

1. Field of the Invention

The present invention relates to a plumbing fixture, having at least a housing and a cartridge secured in the housing.

2. Description of the Background Art

It is basically known that a variety of different electrical and/or mechanical components can be placed in housings of plumbing fixtures, such as, for example, valve units and here particularly also the so-called mixing valve, which is designed as a cartridge. It is known, in addition, that such housings may be made different materials, for example, from cast iron, from sheet metal, or also from plastic.

With the goal of a simple installation and low production cost, efforts are made to design the integration of the parts in the housing to be as simple as possible to handle. Further, the construction should be provided as light as possible and with low-priced materials. In particular, time-consuming reworking of the individual components, especially of the housing, before the installation of the parts should be avoided. But it must also be considered that the integration of the parts into the housing require precise positioning of the components to one another despite the smallest possible installation space. This applies in particular, because tightness against a water breakthrough is to be assured and/or corrosion is to be prevented long term, even if the plumbing fixture is subjected to varying or intensive stress.

SUMMARY OF THE INVENTION

On this basis, it is an object of the present invention to solve the problems described at least partially with respect to the state of the art. In particular, a plumbing fixture is to be proposed which is simple to produce and which requires little effort during installation. In addition, lightweight construction is to be considered here. It is furthermore the goal during installation to compensate in a simple way for tolerances arising during production and to still realize a secure interconnection of the parts to one another.

It should be pointed out that the individually stated features in the claims can be combined in any technologically reasonable manner and illustrate further exemplary embodiments of the invention.

The plumbing fixture has at least following components: a housing, which forms an opening surrounded by a collar and an interior space, a fastening member, which can be disposed adjacent to the collar in the housing, a cartridge holder, which can be positioned in the interior space, a cartridge, which can be positioned at least partially in the interior space, and a tensioning member, which by direct contact can tension at least the cartridge or the cartridge holder against the fastening member.

The housing can be made as a one-piece or multi-piece part. The housing can be metallic and/or made with plastic. Such a housing regularly has a base or a housing lower side and a housing upper side, whereby the housing in the area of the base can be attached, for example, to a vanity and an operating lever can be provided in the area of the housing upper side. The housing has if necessary a substantially barrel-shaped basic design, whereby a type of discharge nozzle can be provided from which water then emerges. Alternatively, the housing can also have cylindrical, square, oval, polygonal, or other basic forms. The housing furthermore has a (single and/or circumferential) collar, which surrounds an opening of the housing. The collar can create in particular a closure for the housing in the area of the housing upper side. The opening is preferably round. The collar is formed inwardly particularly in the direction of a central axis of the housing. An interior space is then formed inside adjacent to the opening. The interior space of the housing is especially so large that it can accommodate the parts to be secured therein (here particularly at least the fastening member, the cartridge holder, the cartridge, and the tensioning member). Nevertheless, the opening must not be so large that all these parts can be pushed through there; rather, it can also be provided that these components are inserted from the bottom into the interior space. In this case, the interior space is formed running between the base and housing upper side of the housing.

Furthermore, a fastening member is provided which can be positioned in the interior space and optionally rests in its entirety inwardly against the collar. The fastening member is especially a separate part, which with its outer surface rests against an inner surface of the housing, but is not connected to it, so that the fastening member can no longer execute a relative movement toward the housing. The installation of the fastening member can occur from the bottom. It is also possible, however, that the fastening member is deformable for the purposes of installation, can be inserted through the collar through the smaller opening, and then widens, so that the outer, top front side of the fastening member, made ring-shaped, can be brought to rest inwardly against the collar or is already fixed in this stop position. It is preferred that the fastening member is made of a different material than the housing.

Furthermore, a cartridge holder is provided which can be positioned in the interior space. Consequently, the cartridge holder can be held, guided, or fixed directly/indirectly in the housing. The cartridge holder moreover has the task of receiving the cartridge. This is to occur particularly so that a directed positioning of the cartridge in the housing is possible, especially that the corresponding connections or outlets for water and/or the positioning of the operating level during installation can be realized in a simple way. In addition, the cartridge holder can fulfill the function of an adapter, whereby the cartridge holder or a number of different cartridge holders can be inserted into the housing and accordingly receive different embodiment variants of the cartridge in a directional manner. The cartridge holder is formed in particular cup-shaped, whereby plastic is preferably used as the material here.

Further, the cartridge (together with the cartridge holder) can be positioned in the interior space. For this purpose, the cartridge sits particularly in suitable recesses of the cartridge holder. It is not absolutely necessary that the cartridge is accommodated completely in the cartridge holder. It can be sufficient that a directed guiding and fixation, for example, of the bottom part of the cartridge in the cartridge holder is made possible. It could be preferable that the cartridge optionally has an indentation or a (radially circumferential) stop edge, which can also be brought into contact with the tensioning member, so that the tensioning member simultaneously presses or secures the cartridge positionally in the cartridge holder.

Moreover, a tensioning member is provided which preferably can be mounted via the opening of the housing. It works together especially with the fastening member so that a tension force can be built up between the fastening member, on the one hand, and the cartridge and/or the cartridge holder, on the other. It is preferably provided for this purpose that the parts fastening member, cartridge holder, and cartridge, are positioned first in the housing and the tensioning member is then brought through the opening into operative engagement with the fastening member. During the installation, the tensioning member is preferably moved axially in the interior space, whereby the tensioning member then also comes into contact with the cartridge holder and/or the cartridge. A further shifting of the tensioning member into the interior space now applies a force to the cartridge holder and/or the cartridge, so that these are pressed into the housing or its support. As soon as the predetermined position is reached, the tensioning member is stopped by the fastening member, so that an independent backward movement of the tensioning member out of the housing is prevented. On the one hand, it is braced in the installed state against the collar of the housing via the fastening member and, on the other, directly on the cartridge and/or the cartridge holder. This simple installation aid serves in particular to compensate for axial manufacturing tolerances within the housing.

It is considered to be especially advantageous that the tensioning member has an internal guide sleeve for the cartridge and an external form-fit engagement with the fastening member. The tensioning member is very especially preferably formed plate-like, particularly as a (radial) disk, whereby on one side a type of (axial) tube-shaped connecting piece is formed. This tube-shaped connecting piece together with the plate forms internally a guide sleeve for the cartridge. In other words, this also means that the inner surface of this guide sleeve substantially comprises an outside diameter of the cartridge, where the tensioning member is to surround the cartridge. In particular, in the area of the plate an outside structure is provided, which can work together with a corresponding structure of the fastening member and is also stoppable. To this end, in particular form elements are provided, which realize a (releasable) form-fit engagement of both parts. Thus, for example, guide grooves, catches, or similar form elements can be provided here. It is very especially preferred here that the tensioning member forms a stop edge which is located opposite to the tube-shaped connecting piece and optionally works together with a corresponding outer contour/stop edge of the cartridge and can press the cartridge in the axial direction further into the housing.

According to an embodiment variant, the tensioning member and the fastening member form a mutual thread. The particular meaning here is that the tensioning member, especially in the area of the plate, has an outer thread, whereas the fastening member, especially having the form of a sleeve or ring, forms a corresponding inner thread on the inside surface. This allows for a suitable tension force to be realized by establishing a screw connection, when the tensioning member travels further into the interior space of the housing.

It can be provided further that the cartridge holder is held in the interior space guided in an insert. The insert can also be, for example, a (more complex) inner housing, whereby especially in the case that the housing is made with metal, this insert can now be made with plastic and predetermines the water course in the interior of the housing, inter alia. It is possible that this insert is tensioned likewise in the housing or pressed in there by means of the fastening member and/or the tensioning member during the installation of the tensioning member by direct/indirect contact.

It can be provided in addition that the housing in the interior space has a bottom stop, which forms a support for the cartridge holder. In other words, this means in particular that the cartridge holder is tensioned (indirectly/directly), on the one hand, against the collar and, on the other, against the bottom stop, so that here the force applied by the tensioning member is transmitted, on the one hand, to the collar (first support) and, on the other, at the bottom stop (second support) into the housing. It would be basically possible that the cartridge holder works together with the bottom stop as a support, for example, also via an insert.

Moreover, it is regarded as advantageous that the housing is formed with half-shells. In this case, the individual parts can be initially prepositioned in the interior space of the housing, and then the half-shells are joined to one another, whereby then only the tensioning member must still be inserted via the opening into the interior space for the final installation. The advantageous tensioning by the tensioning member, moreover, has the result that manufacturing tolerances in the half-shells can be compensated in a simple way. Alternatively, the housing can be preinstalled first with the insert and the fastening member and the cartridge inserted later, for example, after a galvanic treatment.

The fastening of the cartridge occurs accordingly very especially preferably by a single tensioning member formed in the manner of a central disk. This tensions the cartridge together with the cartridge holder in a fastening member, made as a threaded ring, between two corresponding supports in the housing. By tightening this central disk, the parts, cartridge holder and fastening member, are tensioned together axially, whereby height tolerances can be compensated and the cartridge is simultaneously pressed in. In this case, for example, finishing of the housing after the gluing together of the housing half-shells is also no longer necessary. Moreover, a separable pressing operation and thereby a simple installation and removal of the cartridge assembly are possible, without additional fastening elements being necessary. It is furthermore made possible that the fastening member is provided with a material having an appropriate strength (possibly increased relative to other parts).

The invention and the technical environment will be described in greater detail with the use of figures. It should be pointed out that the same parts in the figures are proved with the same reference character. In addition, it should be noted that the figures are schematic and the invention is not limited to embodiment variants shown therein. In the drawing:

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
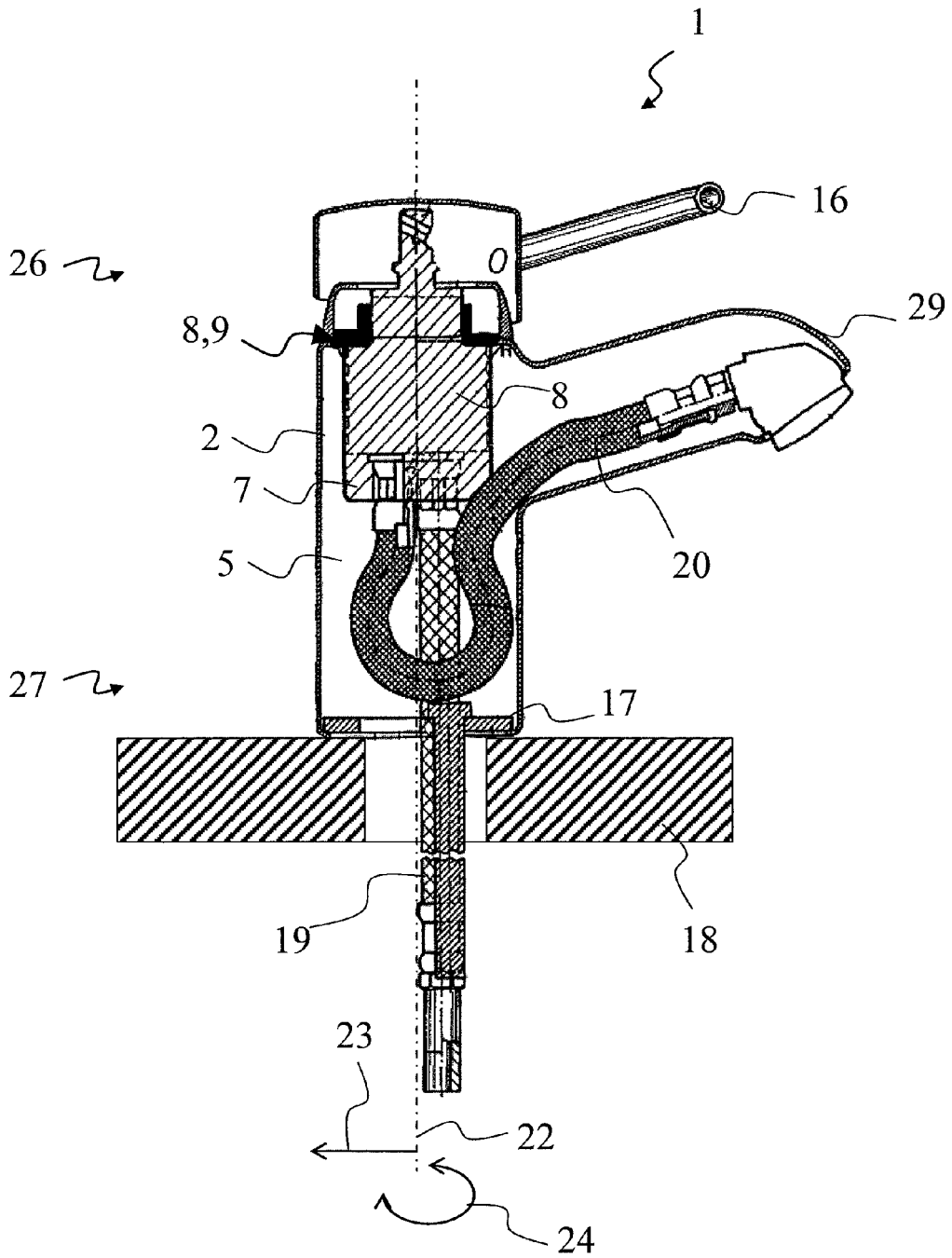
FIG. 1 shows the structure of a plumbing fixture.

FIG. 1 shows a plumbing fixture 1, which is mounted on a vanity 18 by means of suitable mounting brackets 17. Plumbing fixture 1 has a housing 2, which is positioned above vanity 18. A cartridge holder 7, in which a cartridge 8 is also positioned, is provided therein in an interior space 5. Mounting bracket 17 and water intake 19 extend through vanity 18 in the direction of an axis 22. Whereas mounting bracket 17 is anchored in the area of base 27 of housing 1, water intake 19 penetrates interior space 5 up to cartridge holder 7. Connections to cartridge 8 are provided there, so that water conditioning can occur here (particularly hot/cold adjustment). A water outlet 20, formed here in the manner of a hose, then extends again proceeding from cartridge 8 or cartridge holder 7. On the right on housing 2 a type of nozzle is formed, which receives the spray plate for discharging the water. Above, in the area of housing upper side 26 of housing 1, operating lever 16 can also be seen, with which a user of plumbing fixture 1 can regulate the water flow or water temperature. In the area of housing upper side 26 of housing 2, a fastening member 6 and a tensioning member 9 are indicated, with which a tensioning of the cartridge and/or cartridge holder against fastening member 6 is made possible.

Figure 2:
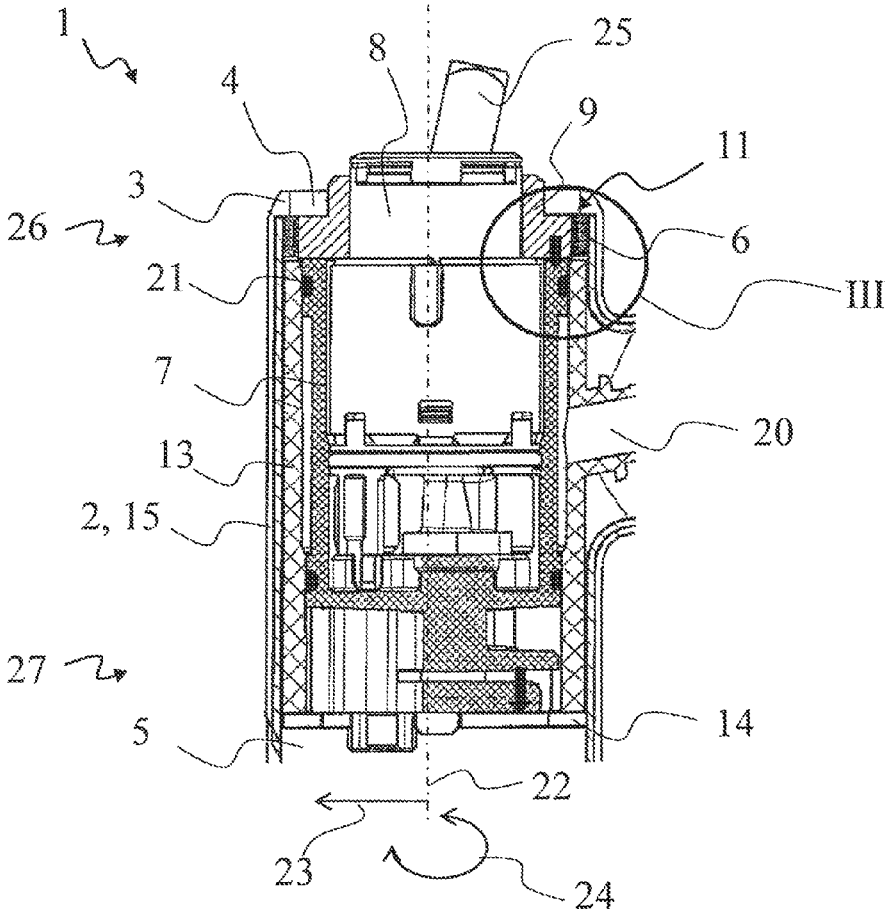
FIG. 2 shows a cross section through an embodiment variant of the plumbing fixture with cartridge holder.

FIG. 2 shows an exemplary embodiment of a plumbing fixture 1, whereby here in interior space 5 of housing 2 formed with half-shells 15, a bottom stop 14 is formed in the area of base 27. Bottom stop 14 can be part of housing 2 and/or a part of insert 13, which is provided here also to form water course 20 internally adjacent to housing 2. Housing 2 above in the area of housing upper side 26 has a closing, inwardly directed collar 3, defining a circular opening 4. A separate fastening member 6 in the manner of a ring is positioned internally adjacent and propped against collar 3. This is made particularly so that it cannot be pushed axially through opening 4. Wall sections of insert 13 are positioned below or opposite on the front side. Insert 13 itself is supported against bottom stop 14. The design of insert 13 is preferably so that fastening member 6 can be inserted easily into the gap between insert 13 and collar 3 with sufficient play and with consideration of the potential manufacturing tolerances. A cartridge holder 7 is now accommodated within housing 2 and particularly also within insert 13. Cartridge holder 7 can also form in particular guides or connections for water intake 19 toward the base. A seat for cartridge 8, already integrated here, is provided opposite to or directed toward the housing upper side. Cartridge 8, particularly, for instance, in the area of an axial front side of cartridge holder 7, also has a stop edge 28 extending in the direction of radius 23 and made at least partially enclosing in the direction of circumference 24.

For installation, tensioning member 9 is now placed over the cartridge (8) part projecting outside opening 4 of housing 2 and brought into operative engagement with fastening member 6 behind collar 3. Here elements are provided for a form-fit engagement 11 between tensioning member 9 and fastening member 6. During installation, tensioning member 9 is then moved in the direction of axis 22, whereby through direct contact of tensioning member 9 with cartridge 8 and/or cartridge holder 7 a tension force is produced, so that height tolerances between the parts collar 3, fastening member 6, and cartridge 8/cartridge holder 7, can be compensated. This causes a tensioning of the indicated parts in interior space 5 of housing 2.

Figure 3:
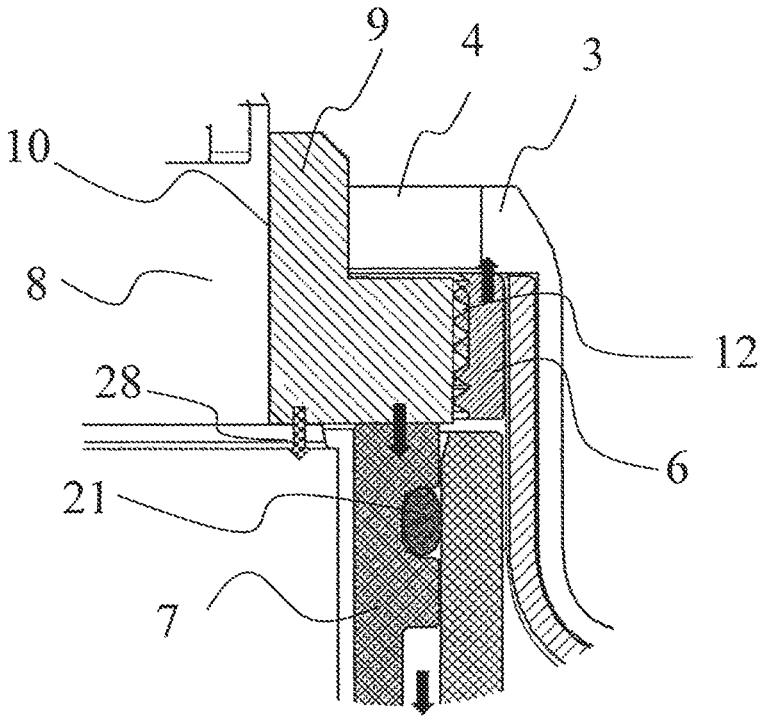
FIG. 3 shows a detail of an embodiment variant of the plumbing fixture in the area of the tensioning member.

FIG. 3 shows a detail for an embodiment variant of the fastening or tensioning, approximately in area "III" in FIG. 2. It can be seen here that tensioning member 9, on the one hand, forms an internal guide sleeve 10 for cartridge 8 and moreover forms a mutual thread 12 on the outside with fastening member 6. If fastening member 6 is screwed into the thread pitch during installation, a tensioning of cartridge holder 7 against collar 3 of housing 2 occurs here. A tensioning of cartridge 8 in cartridge holder 7 can occur at the same time, particularly in that tensioning member 9 acts axially on a stop edge 28 of cartridge 8. The tensioning of the parts should occur preferably only in the axial direction, particularly in order not to damage the seals 21 located between the parts. The tensioning of the various elements are shown by the arrows in FIGS. 2 and 3.

The invention thus solves the aforementioned problems and provides in particular an easily installable and cost-effective plumbing fixture.

As a precaution, it should also be pointed out that the combinations of technical features as shown in the figures are not obligatory in general. Thus, the technical features of a figure can be combined with other technical features of another figure and/the general description. Something different should apply only if the combination of features was explicit here and/or the person skilled in the art realizes that the basic function of the plumbing fixture (providing of water) can otherwise no longer be fulfilled.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A plumbing fixture comprising:

a housing having an interior space and an opening provided at an upper end thereof, the opening of the housing surrounded by a collar;

a fastening member disposed entirely in the interior space of the housing and adjacent to the collar;

a cartridge holder arranged in the interior space;

a cartridge positioned at least partially in the interior space; and a tensioning member positioned between both the fastening member and the cartridge and the fastening member and the cartridge holder, such that the tensioning member directly contacts the fastening member and the cartridge or the cartridge holder, so as to produce tension between at least the cartridge or the cartridge holder and the fastening member.

2. The plumbing fixture according to claim 1, wherein the tensioning member has an internal guide sleeve for the cartridge and an external form-fit engagement with the fastening member.

3. The plumbing fixture according to claim 1, wherein the tensioning member and the fastening member form a mutual thread.

4. The plumbing fixture according to claim 1, wherein the cartridge holder is held in the interior space guided in an insert.

5. The plumbing fixture according to claim 1, wherein the housing in the interior space has a bottom stop, which forms a support for the cartridge holder.

6. The plumbing fixture according to claim 1, wherein the housing is formed with half-shells.

7. The plumbing fixture according to claim 1, wherein a first surface of the fastening member directly contacts an interior wall of the housing and a second opposing surface of the fastening member directly contacts an outer surface of the tensioning member.

8. The plumbing fixture according to claim 7, wherein the second surface of the fastening member and the outer surface of the tensioning member are each provided with mutual cooperating threads, wherein the fastening member is attached to the tensioning member via the threads.

9. The plumbing fixture according to claim 1, wherein in the collar and the housing are a single, monolithic structure.

10. The plumbing fixture according to claim 1, wherein the tensioning member directly contacts the cartridge, the cartridge holder and the fastening member.

* * * * *